US005547178A

United States Patent [19]

Costello

[11] Patent Number: 5,547,178

[45] Date of Patent: Aug. 20, 1996

[54] PRINTER MAILBOX SPLIT JOBS OVERFLOW BANNER SHEET INDICATOR SYSTEM

[75] Inventor: Mark Costello, Rochester, N.Y.

[73] Assignee: Xerox Corporation, Stamdford, Conn.

[21] Appl. No.: 393,605

[22] Filed: Feb. 23, 1995

[51] Int. Cl.[6] ..... B65H 39/00

[52] U.S. Cl. ..... 270/52.02; 270/52.03; 270/52.06; 270/58.18

[58] Field of Search ..... 270/58.05, 58.03, 270/58.31, 58.14, 58.18, 58.19, 52.03; 271/298

[56] References Cited

U.S. PATENT DOCUMENTS

| | | | |
|---|---|---|---|
| 3,871,643 | 3/1975 | Kukucka et al. | 271/290 |
| 4,211,483 | 7/1980 | Hannigan et al. | 270/58.18 X |
| 4,522,486 | 7/1985 | Clark et al. | 355/323 |
| 5,316,279 | 5/1994 | Corona et al. | 270/95 X |
| 5,328,169 | 7/1994 | Mandel | 271/290 |

*Primary Examiner*—John E. Ryznic

[57] ABSTRACT

In a shared users printing system, with an electronic printer for printing print jobs of respective different plural users, with a printer mailbox system for receiving the print jobs in multiple mailbox bins of a limited sheet capacity, and a sheet distribution system for automatically directing into different individual mailbox bins assigned to different users their respective print jobs, with at least the initial sheets of a particular user directed to a selected first mailbox bin, a control system controls the sheet distribution system in a job splitting program in accordance with the maximum sheet stacking capacity of the first bin to divert subsequent printed sheets being printed for that user which would exceed the maximum capacity to at least one other bin and in coordination therewith automatically prints and inserts a special banner sheet as the last sheet inserted into the first bin, as the top sheet, with a readable indication that the subsequent printed sheets for that user are being so diverted to other bin(s), and indicating their locations. The banner sheets are only printed for such job splitting, and not for normal unsplit print jobs. Another special banner sheet is automatically printed and inserted into the other bin with the diverted subsequent printed sheets in a position to identify them. The other bin may be a higher sheet stacking capacity overflow tray which is commonly shared by plural users.

9 Claims, 7 Drawing Sheets

PRINTER MAILBOX SPLIT JOBS OVERFLOW BANNER SHEET INDICATOR SYSTEM

Cross reference is made to a copending commonly assigned U.S. application Ser. No. 08/393,604, attorney docket no. D/94656, by Hector J. Sanchez, John P. Serio and Ronald S. Tomory, entitled "Printing and Mailboxing System for Shared Users with Bins Almost full Sensing," filed Feb. 23, 1995.

There is disclosed an improved system of separating by different users the print jobs of printed sheets outputted by a shared user printer, as in office networked printer systems, into respective limited sheet capacity bins of a plural bin physical mailbox system, with a system of specially generated "banner sheets" (cover sheets) for split jobs. Although splitting print jobs between mailbox bins is generally not desirable, it is desirable or required in certain cases for increased productivity and maximizing utilization of the printer output and mailbox system, and the present system enables such split jobs to be much more easily located and recovered intact by the user.

It is well known to automatically print "banner sheets" for all print jobs in non-mailbox system electronic printers with shared users. E.g., Xerox Corp. U.S. Pat. No. 5,316,279, D/92217 issued May 31, 1994, by S. Corona, E. Fox and N. Robinson on such banner cover sheets. Such a banner sheet may be automatically printed by the printer and automatically inserted before or after the printing of the first or last sheets of each print job to provide job or set distinguishing and user identifying printing indicia, preferably visible from the top of the stack of sheets comprising the print job, if not obscured. As is described in said U.S. Pat. No. 5,316,279, such banner sheets were (heretofore) provided primarily as job separator sheets for commonly stacked (comingled) print jobs, especially of different users. However, such banner sheets can be obscured in common plural job stacks, and they waste paper when used for each print job. The automatic generation of such banner sheets in a printer is well known per se from these and other references and need not be described in detail herein.

Another, different, and preferred means and method of separating the print jobs of different users of a shared printer, without requiring banner sheets, is a "mailboxing" system, in which the different users jobs are placed in different bins. Printer mailbox systems are further described below, and in the patents thereon cited below.

In the exemplary system embodiment disclosed herein, even though such a mailboxing system is utilized, so that banner sheets are not desirable or needed for most print jobs, it has been discovered that in certain special job printing situations, where a print job or jobs should be split between mailbox system bins, and job sheets partially diverted to at least one other mailbox bin, due to anticipated exceeding of the sheet stacking capacity of a mailbox bin, that it is highly desirable to automatically print and automatically insert a new and different type of banner sheet, which special banner sheet will be the last sheet inserted into that bin so as to be the top sheet in that bin, and which special banner sheet will indicate a split job to that user. Said special banner sheet will also preferably indicate that the remainder of that users print job(s) may be found in another bin or bins, and will preferably identify in which said bin(s) they have been so diverted. An additional special identifying banner sheet may also be desirably automatically printed and inserted on top of the split job sheets diverted to that other mailbox bin. Especially, if the diverting bin for that split job is a higher capacity shared overflow tray into which other print jobs may be comingled. The decision for the print jobs to be split between bins, and the special banner sheet or sheets generated therefor, may be controlled or partially controlled by an in-bin sheet capacity sensing system, if desired, and/or print sheet job count information.

By way of current background as to printer mailbox systems and sensors, as further discussed below, U.S. Pat. No. 5,328,169 issued Jul. 12, 1994 to Barry P. Mandel teaches, inter alia, a mailbox system "bin empty" sensors system and its system for rerouting print jobs to mailbox bins. It also describes some controls based on counting the number of sheets of a print job sent to be printed or being printed in the printer and/or inputted into a mailbox bin for a particular user. This patent also discusses problems caused by the fact that in order to provide overall compactness of a printer mailbox unit, the sheet stacking capacity of most of the individual mailbox bins thereof must be fairly limited. Thus, very large multisheet print jobs or large numbers of plural print jobs for a particular user will normally not all fit at once into one mailbox bin, without the removal of prior print jobs from that bin.

However, a mailbox bins sheet stacking capacity cannot be measured exactly in bin directed sheet counts (the sheet input count from the printer for sheets directed to that bin, or a bin sheet entrance sensor count), because the actual stacking height in the bin can vary with the sheet thickness, sheet curl, etc.. An in-bin "bin full" stack height sensor, provided to overcome that problem and to tell when a bin is actually full, will provide such a signal too late to redirect a substantial number of remaining sheets of a print jobs to another available bin without splitting up a print job already in process between different mailbox bins, because no more sheets (or only a few more sheets) can be put into that bin.

Also, a "bin empty" sensor based system, as in U.S. Pat. No. 5,328,169 cited above, has not been found to be fully effective or fully efficient for a mailbox bin assignment control system. In particular, it has been found that there are situations in which a user pulls out only part of the print jobs from that users bin(s), and leaves other sheets still in the bin. A "bin empty" sensor will not be activated in that case, and thus cannot tell the mailbox control system that this bin is now available for receiving and stacking further print jobs, even though the usable bin capacity may now be substantial. Likewise, even if the system is one in which the system controller has been tracking (counting) the number of printed sheets sent to that bin since the last time that bin was fully emptied, that count would no longer represent the actual number of sheets in the bin after such a partial removal of sheets from the bin. Also, printer jam clearances can affect the actual sheet count, and thus the actual stack height in the bin. That is, these situations can fool or confuse a "bin empty" sensor system, and a bin assignment control system when that "bin empty" sensor is interrogated later, even if the mailbox bin is actually now almost empty.

Further disclosed features of the specific embodiment hereinbelow include, in a shared users printing system, with an electronic printer for printing respective plural print jobs of plural printed sheets of respective different plural users of said printer, with a printer mailbox system connected to said electronic printer to receive said print jobs from said electronic printer, said printer mailbox system having multiple individual print job storage mailbox bins of a limited preset maximum sheet stacking capacity, and a sheet distribution system for automatically variably directing and stacking into different said individual mailbox bins electronically assigned to different respective users the respective plural print jobs of the different plural users of said electronic printer, wherein at least the initial portion of a first print job of a particular user is directed to a selected first said mailbox bin assigned to that user, the improvement comprising a control system controlling said sheet distribution system in a job splitting program in accordance with said maximum sheet stacking capacity of said first bin to divert subsequent printed sheets of a print job being printed for that particular user which would exceed said maximum sheet stacking capacity of said first bin to at least one other bin and in coordination therewith controlling said printer to automatically print and automatically insert a special banner sheet as the last sheet inserted into said first bin as the top sheet in said first bin, which special banner sheet is automatically printed with readable indicia indicating that said subsequent printed sheets for that user are being so diverted to said other bin.

Additional disclosed features of the specific embodiment hereinbelow include, individually or in combination, an in-bin sensing system providing a control signal to said control system indicating when said maximum sheet stacking capacity of said first bin is being reached; and/or wherein said electronic printer is provided with electronic information as to the number of printed sheets of a print job being printed for that particular user, and wherein said control system controls said sheet distribution system to direct a subsequent print job from said electronic printer which would exceed said limited preset maximum sheet stacking capacity of said first bin to a different said individual mailbox bin; and/or wherein said banner sheets are only printed in response said job splitting program for a partially diverted said print job and not for normal unsplit print jobs; and/or wherein another special user identifying banner sheet is automatically printed and inserted into said other bin with said diverted subsequent printed sheets of said print job in a position to identify said diverted subsequent printed sheets; and/or wherein said other bin comprises a higher sheet stacking capacity overflow tray; and/or wherein said other bin comprises a higher sheet stacking capacity overflow tray which is commonly shared by plural said users; and/or wherein respective said different users of said printer are in networked electronic communication with said printer from respective user terminals, wherein at least some of said respective different plural users of said printer are at remote said user terminals, and said control system is partially programmable by said respective users from said respective user terminals; and/or further including an in-bin sensing system providing a control signal to said control system indicating when said maximum sheet stacking capacity of said first bin is being reached; wherein said electronic printer is provided with electronic information as to the number of printed sheets of a print job being printed for that particular user, and wherein said control system controls said sheet distribution system to direct a subsequent print job from said electronic printer which would exceed said limited preset maximum sheet stacking capacity of said first bin to a different said individual mailbox bin; wherein said banner sheets are only printed in response said diverted print job and not for normal print jobs; and wherein another special user identifying banner sheet is automatically printed and inserted into said other bin with said diverted subsequent printed sheets of said diverted print job in a position to identify said diverted print job.

By way of further background, printing and mailboxing systems for shared users, including exemplary bin empty or bin use sensors, and its needs and reasons, are also taught and explained in detail in said above-cited Xerox Corporation U.S. Pat. No. 5,328,169, and related specifications, such as U.S. Pat. No. 5,358,238, and thus need not be described in detail herein. The presently disclosed system and embodiment and its status signals are fully compatible and combinable with said mailbox "bin empty" (or "bin not empty") signals and their functions and operations as disclosed in said prior patents. These references, and other art cited therein, teach various other optional or desirable mailbox features, some of which are noted below. That includes the unlocked or open bin copier or printer "mailbox" description provided in Xerox Corporation U.S. Pat. No. 5,098,074 issued Mar. 24, 1992 to Mandel, et al., especially FIG. 4 and its description; and a printer mailboxing system with locking bins disclosed in Xerox Corporation EPO application No. 0 241 273 published Oct. 14, 1987; and Seiko Epson Corporation U.S. Pat. No. 5,141,222 issued Aug. 25, 1992 by Shigeru Sawada, et al., with "bin full" signals. There are also several commercial printer mailbox systems now available, but with relatively limited control functions.

As described in said cited patents, a mailbox can be used as an output accessory for various existing or future printers. The term printer can broadly encompass, e.g., various known discrete, connected, and/or multifunction devices such as those providing local digital copier, scanner, facsimile and/or networked PDL or electronic mail printer functions. A mailbox system may automatically discretely handle and segregate shared printer outputs by printer users, from various types of printers. In particular, to provide an output sheet sorting system capable of independently handling and separating different jobs for different users or addressees automatically and simply. A "mailboxing" unit can be a universal modular or stand-alone unit that may be attached to, or even simply moved next to, the output of almost any printer, or it may be integral the printer. Plural sets or jobs of plural physical sheets outputted by a printer can be directed into a particular mailbox bin, or set of bins, and those bins of the particular customer or user can be indicated for job retrieval. This allows plural users of a printer to have a shared system which automatically puts different users outputs into different "mailboxes". Mailbox bins may also, if desired, have locked access privacy doors or the like, and automatic unlocking systems, as also taught by the above cited and other patents cited therein. If desired, as also so taught, integral job set compiling and finishing (e.g., print job set stapling) and stacking may also be provided in a mailboxing system.

The kind of mailboxing described herein is for "hard copies", i.e., conventional printed image physical substrate sheets of paper and the like, and should not be confused with electronic document page storage systems used in facsimile machines and network printing document inputs, etc.. The term "sheet" or "hard copy" herein refers to a usually flimsy sheet of paper, plastic, or other such conventional individual physical substrate, and not to electronic images. Related, e.g., page order, plural sheets documents or copies can be referred to as a "set", "job" or "print job". A "job" may also refer to one or more documents or sets of documents beings sent to or received by a particular addressee or designee.

With mailboxing systems of the type disclosed herein, printer users or print job recipients do not need to manually separate their print jobs from a common output sheet stack of print jobs of others, or stand by printers awaiting outputs to avoid their print jobs being commingled with print jobs of other users, or read or accidentally taken away by other users. Mailboxing systems address the serious problem of keeping shared (networked) printer job outputs separated and secure, avoiding prior art shared printer system problems where all print jobs are commonly stacked together into one output stacking tray.

Although they may use some similar mechanical sheet handling components, printer mailboxes do not sort or collate by sequentially sending single identical copy sheets to different sequential bins or trays, like a conventional sorter or collator. Printer mailboxes separate the printer output of printed sheets into respective bins by respective user's print jobs, and preferably receive precollated sequential sheets input of a complete multisheet job to one bin. Prior art sorters or collators are typically connected to the output of copiers or printers so as prevent the copier or printer from printing at all, at any time, until all the copies are removed from all of the sorter bins, or a full set of bins, or require the copier to switch all output of copy sheets to another set or bank of sorter bins while a first bank or set of bins are all being unloaded.

"Mailboxing" may more specifically, as in the example herein, refer to temporarily (or permanently) assigning a unique and predetermined electronic address to respective ones of plural bins of mechanically sorter-like equipment for a printer output, and enabling a particular user's output of one or more print jobs to be directed into one or more selected bins so assigned. A mailbox for a laser or other electronic page input printer may desirably print and feed plural precollated sets of sheets into a selected single first bin, rather than functioning as a normal collator or sorter, since an electronic page printer can normally easily electronically reorder and recirculate the "original" pages being copied to "copy" and output them in precollated or serial page job set order, rather than making plural directly sequential copies of each page requiring post-collation and separate bins for each copy set as in a sorter or collator.

As is also taught in the above-cited "mailbox" patents, another very desirable and related "mailbox" feature is a variable and virtual bin system, in which the software in a programmed computer or controller controlling the mailbox sheet distributor puts the first job output of user A into an electronically assigned bin X which is determined to be then available from a bin empty sensor. Then, if a subsequent job for user A will also fit into bin X, it is also put into bin X. If not, then the subsequent job for user A is automatically put into an assigned "overflow" bin Y, etc.. I.e., for each user, the number of assigned bins is automatically increased to meet the users need. Adjacent mailbox bins may be selected and used for the job overflow, if available, or a larger capacity overflow tray, as is known for sorters. Plural mailbox units may also be serially ganged, as is know for plural sorters, to increase the number of available bins.

Other art as to bin overflow features in general, for sorters, includes Xerox Corporation U.S. Pat. No. 3,871,643 issued Mar. 18, 1975 to W. Kukucka and T. Acquaviva; IBM U.S. Pat. No. 4,522,486 to Clark et al. (using the term "virtual bin"); and U.S. Pat. No. 4,134,581 to Johnson, et al..

However, as noted in said prior mailbox system patents, with mailboxed pre-stapled job sets, whole job sets may be put into a bin at a time (vs. sheets stacked in the bin one-at-a-time). Thus, the decision to put the next job in another bin should be made in advance, with knowledge of the size of the next job set versus the remaining capacity of the bin presently being used for job stacking.

As to usable specific or alternative hardware or software components of the subject apparatus, it will be appreciated that, as is normally the case, some such components are known per se in other apparatus or applications. Some examples are in the above-cited art and its references.

The presently disclosed apparatus may be readily operated and controlled with conventional control systems. It is well known and commonplace to program and execute imaging, printing, document, and/or paper handling control functions and logic with software instructions for conventional or general purpose microprocessors. This is taught by various prior patents and commercial products. Such programing or software may of course vary depending on the particular functions, software type, and microprocessor or other computer system utilized, but will be available to, or readily programmable without undue experimentation from, functional descriptions, such as those provided herein, or prior knowledge of functions which are conventional together with general knowledge in the software and computer arts. That can include object oriented software development environments, such as C++. Alternatively, the disclosed system or method may be implemented partially or fully in hardware, using standard logic circuits or a single chip using VLSI designs.

As further discussed hereinbelow, it will be appreciated that in a modern system or networked office environment, various of the control and/or software functions described herein may be done in the network system print server or controller rather than in the mailbox unit or the printer unit per se. Likewise, as is also known and taught, user interactions, control and status displays with, for, and from the printing and mailboxing apparatus and its operations can be on and from the terminals or PC's of individual networked users. Control signals and terminal display interactive interfaces between user remote terminals and electronic printers in general are known and commercially available and need not be described in detail herein. Examples of some recent patents relating to network environments of plural remote terminal shared users of networked printers include Xerox Corporation U.S. Pat. Nos. 4,453,128; 5,170,340; 5,226,112; 5,243,518; 5,287,194; EPO 0529818A3 pub. Mar. 3, 1993; and GB 2198566A pub. 15 Jun. 1988. Some patents on this subject by others include U.S. Pat. Nos. 4,623,244; 4,651,278; 4,760,458; 4,821,107; 4,903,229; 4,953,080; 5,113,355; 5,113,494; 5,181,162; 5,220,674; and 5,247,670. Further by way of background, some of the following Xerox Corporation U.S. patents also include examples of networked systems with printers: U.S. Pat. Nos. 5,153,577; 5,113,517; 5,072,412; 5,065,347; 5,008,853; 4,947,345; 4,939,507; 4,937,036; 4,920,481; 4,914,586; 4,899,136; 4,453,128; 4,063,220; 4,099,024; 3,958,088; 3,920,895; and 3,597,071. Some of these patents also disclose multi-functional machines (digital printer/scanner/facsimile/copiers) and their controls.

Some other network systems related publications include "Xerox Office Systems Technology" ". . . Xerox 8000 Series Products: Workstations, Services, Ethernet, and Software Development" ©1982, 1984 by Xerox Corporation, OSD-R8203A, Ed. T. Linden and E. Harslem, with a "Table of Contents" citing its numerous prior publications sources, and an Abstract noting the April 1981 announcement of "the 8110 Star Informations System, a new personal computer . . . "; "Xerox System Integration Standard Printing Protocol XSIS 118404", April 1984; "Xerox Integrated Production Publishers Solutions: . . . " Booklet No. "610P50807" "11/85"; "Printing Protocol-Xerox System Integration Standard" ©1990 by Xerox Corporation, XNSS 119005 May 1990; "Xerox Network Systems Architecture", "General Information Manual", XNSG 068504 April 1985, with an extensive annotated bibliography, ©1985 by Xerox Corporation; "Interpress™: The Source Book", Simon & Schuster, Inc., New York, N.Y., 1988, by Harrington, S. J. and Buckley, R. R.; Adobe Systems Incorporated "PostScript® Language Reference Manual", Addison-Wesley Co., 1990; "Mastering Novell® Netware®", 1990, SYBEX, Inc., Alameda, Calif., by Cheryl E. Currid and Craig A. Gillett; "Palladium Print System" ©MIT 1984, et sec; "Athena85" "Computing in Higher Education: The Athena Experience", E. Balkovich, et al, Communications of the ACM, 28(11) pp. 1214–1224, November, 1985; and "Apollo87" "The Network Computing Architecture and System: An Environment for Developing Distributed Applications", T. H. Dineen, et al, Usenix Conference Proceedings, June 1987.

Noted re commercial network systems with printers and software therefor is the 1992 Xerox Corporation "Network Publisher" version of the 1990 "DocuTech®" publishing system, including the "Network Server" to customer's Novell® 3.11 networks, supporting various different network protocols and "Ethernet™"; and the Interpress Electronic Printing Standard, Version 3.0, Xerox System Integration Standard XNSS 048601 (Jan. 1986). Also, the much earlier Xerox Corporation "9700 Electronic printing System"; the "VP Local Laser Printing" software application package, which, together with the Xerox "4045" or other Laser Copier/Printer, the "6085" "Professional Computer System" using Xerox Corporation "ViewPoint" or "GlobalView®" software and a "local printer [print service] Option" kit, comprises the "Documenter" system. The even earlier Xerox Corporation "8000" "Xerox Network Services Product Descriptions" further describe other earlier Xerox Corporation electronic document printing systems. Eastman Kodak "LionHeart™" systems, first announced Sep. 13, 1990, are also noted. Current popular commercial "systems software" including LAN workstation connections is available from Novell®, Microsoft Windows™, and IBM OS/2.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the examples below, as well as the claims. Thus, the present invention will be better understood from this description of embodiments thereof, including the drawing figures (approximately to scale) wherein:

FIG. 1 is a frontal partially schematic view of one example of a multibin "mailboxing" system unit (in this example, a fixed bins unit) with one example of a moving sheet transport and bin selector (gating) or bin distribution system, and showing one example of a bin "almost full" sensing system, together with a bin full sensing system, with exemplary bin full and almost full sheet stacking levels shown in variably dashed lines in the bins, and a bin empty detection system shown interconnected with vertical dashed lines, in which exemplary subject special banner sheets are shown in two of the bins on top of respective portions of a split print job;

Figure 1:
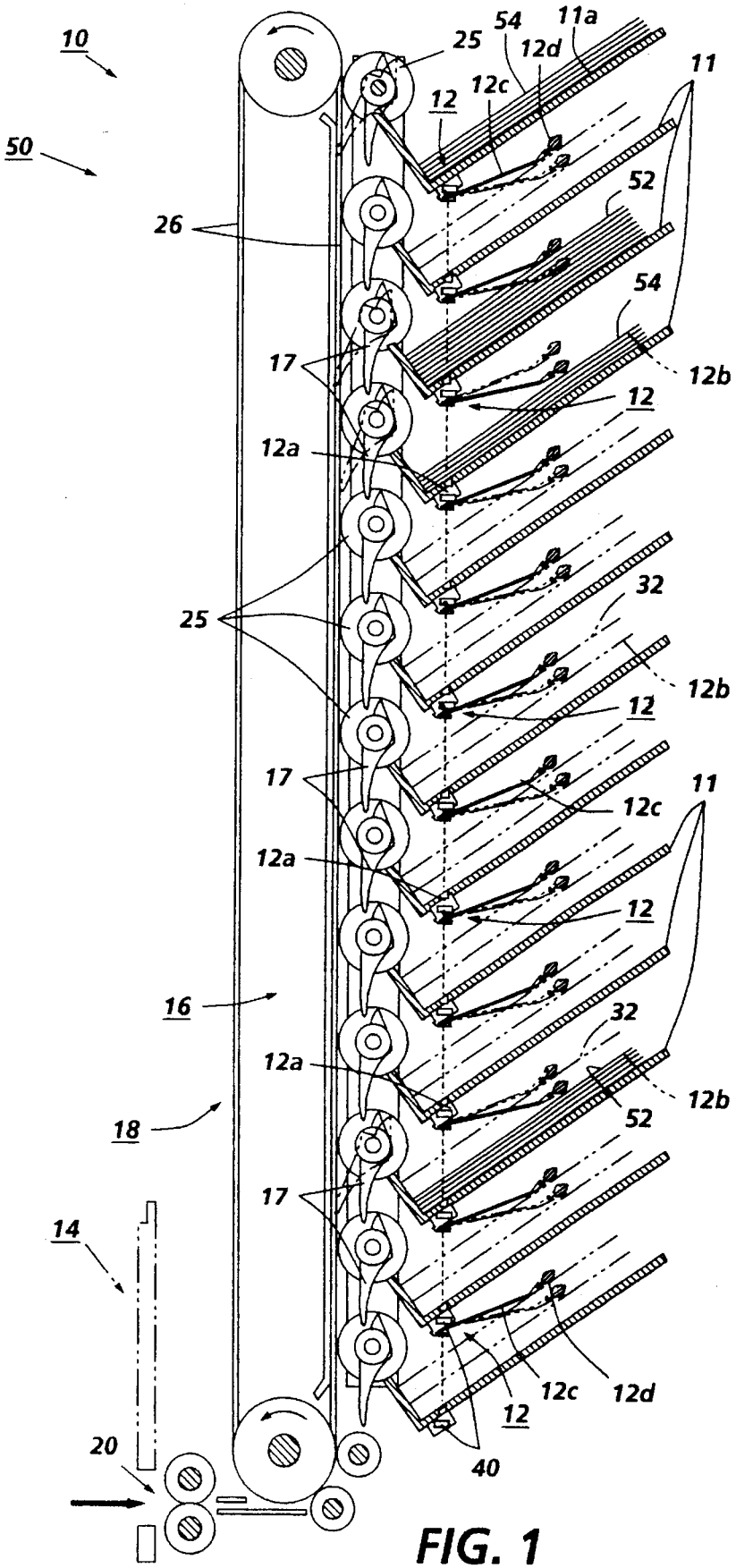
Figure 5:
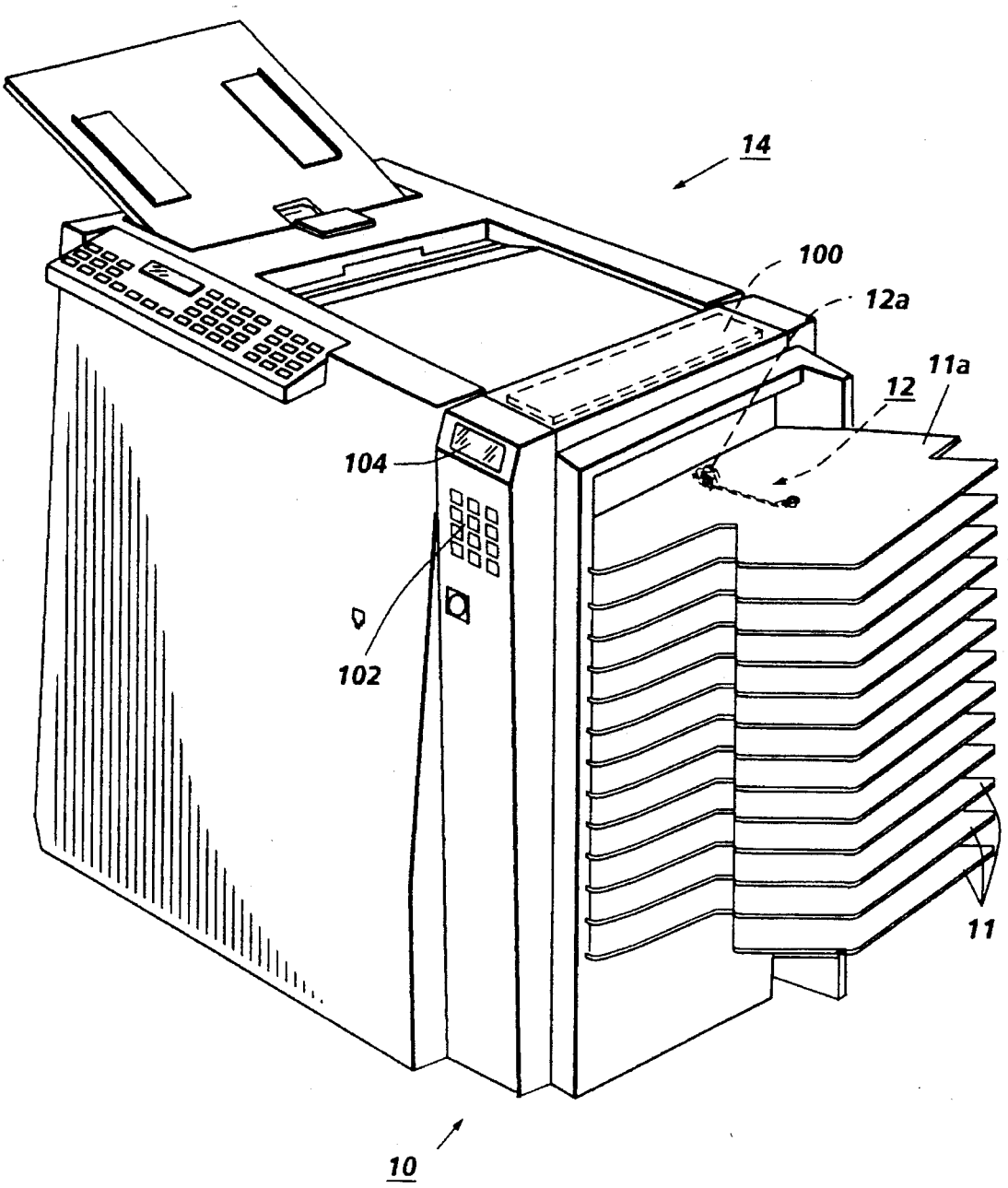
FIG. 5 is a overall perspective side view of an exemplary conventional shared user electronic printer and the connecting exemplary multibin "mailboxing" system unit of FIGS. 1–4 operatively connecting to receive the output of printed copy sheets of said printer, with an exemplary optional display panel and keypad.
Figure 6:
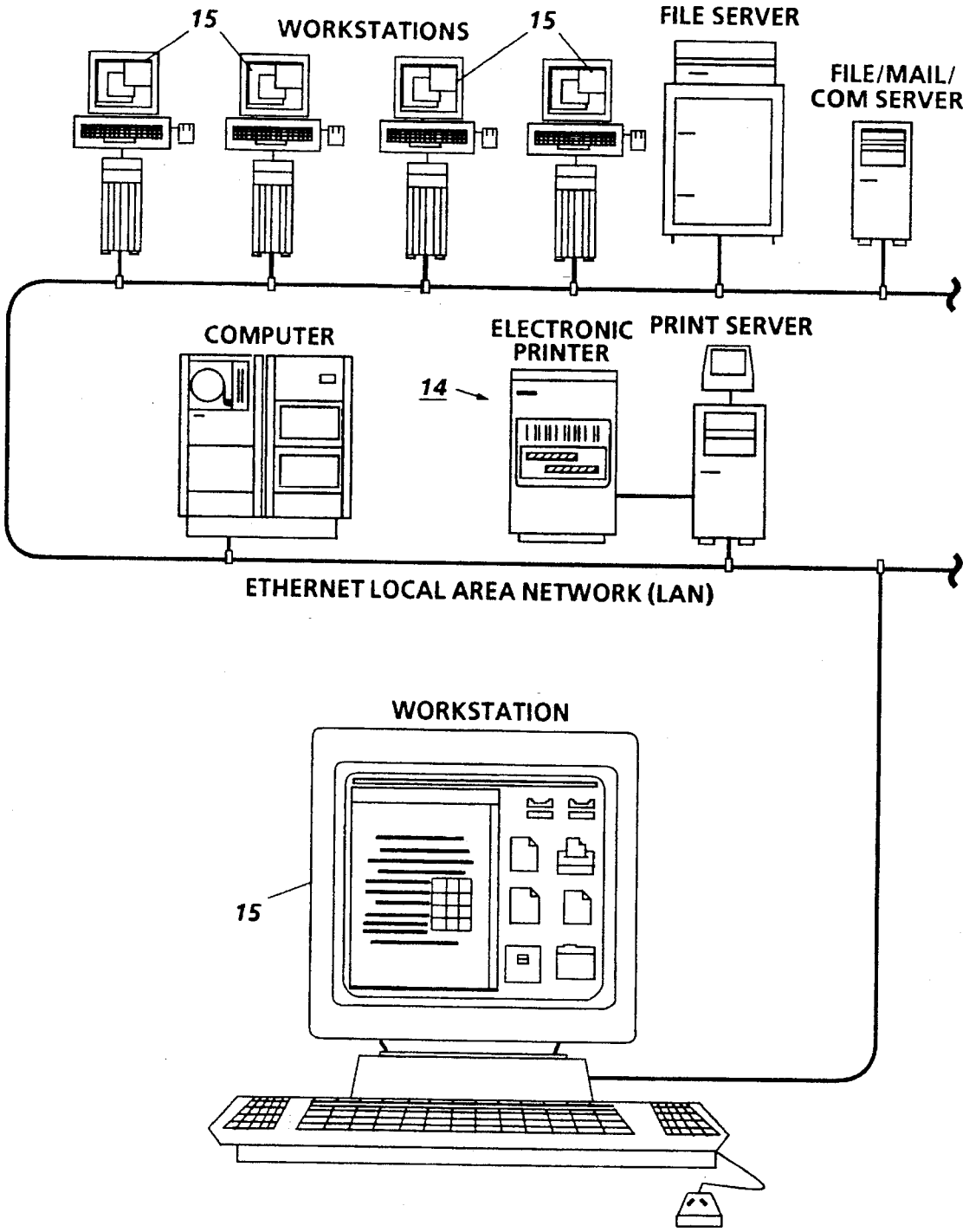
PRIOR ART FIG. 6
Figure 7:
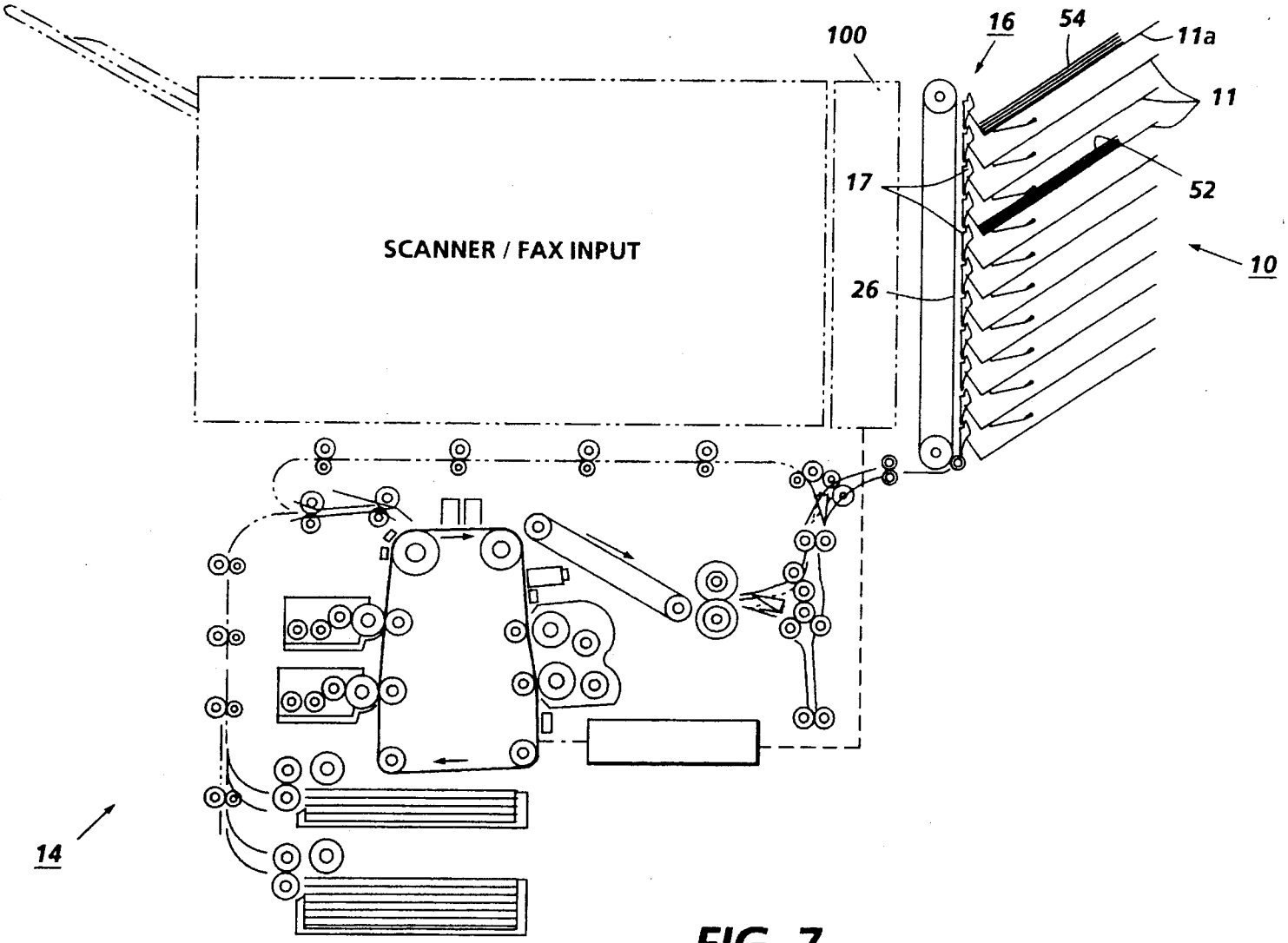
Figure 8:
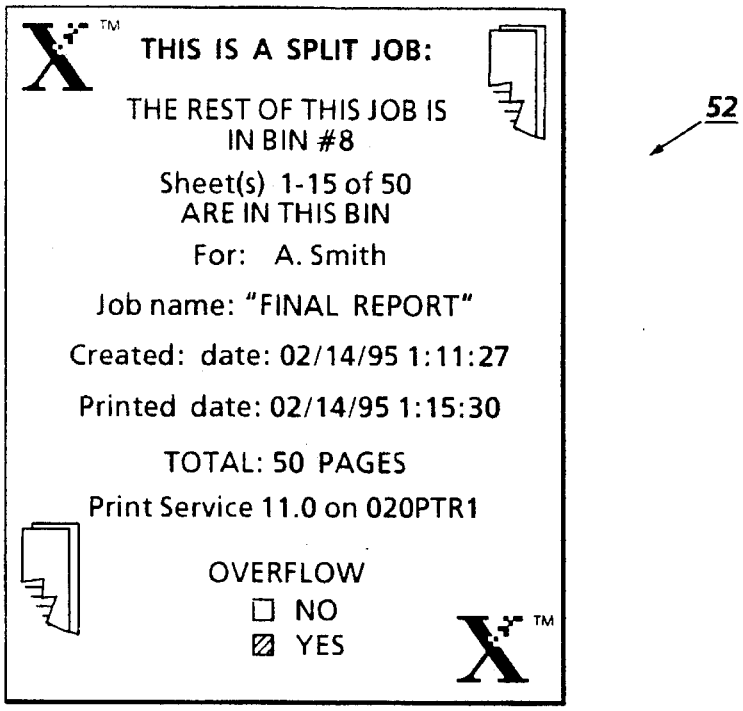
Figure 9:
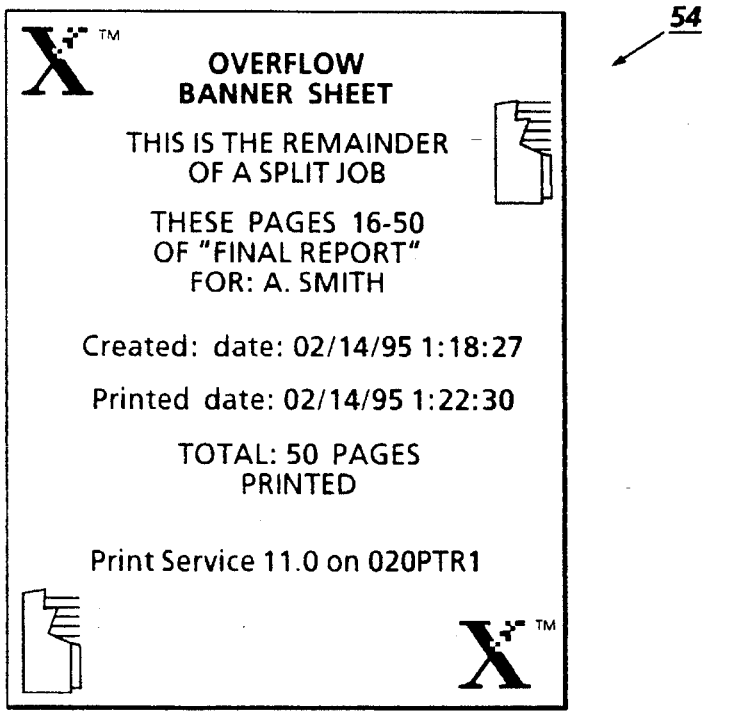

FIG. 6, labeled "prior art", is a schematic overall view of one example of an electronically networked system of plural users (plural workstations) sharing an electronic printer, in end view, based on FIG. 1 of U.S. Pat. No. 5,008,853 issued Apr. 16, 1991, cited herein;

FIG. 7, also labeled "prior art", shown a schematic internal view of an electronic printer such as that of FIG. 5, or otherwise, in which the subject banner sheets may be generated;

FIG. 8 shows an exemplary special first (split job indication) banner sheet;

FIG. 9 shows an exemplary special second (overflow) banner sheet; and

Figure 10:
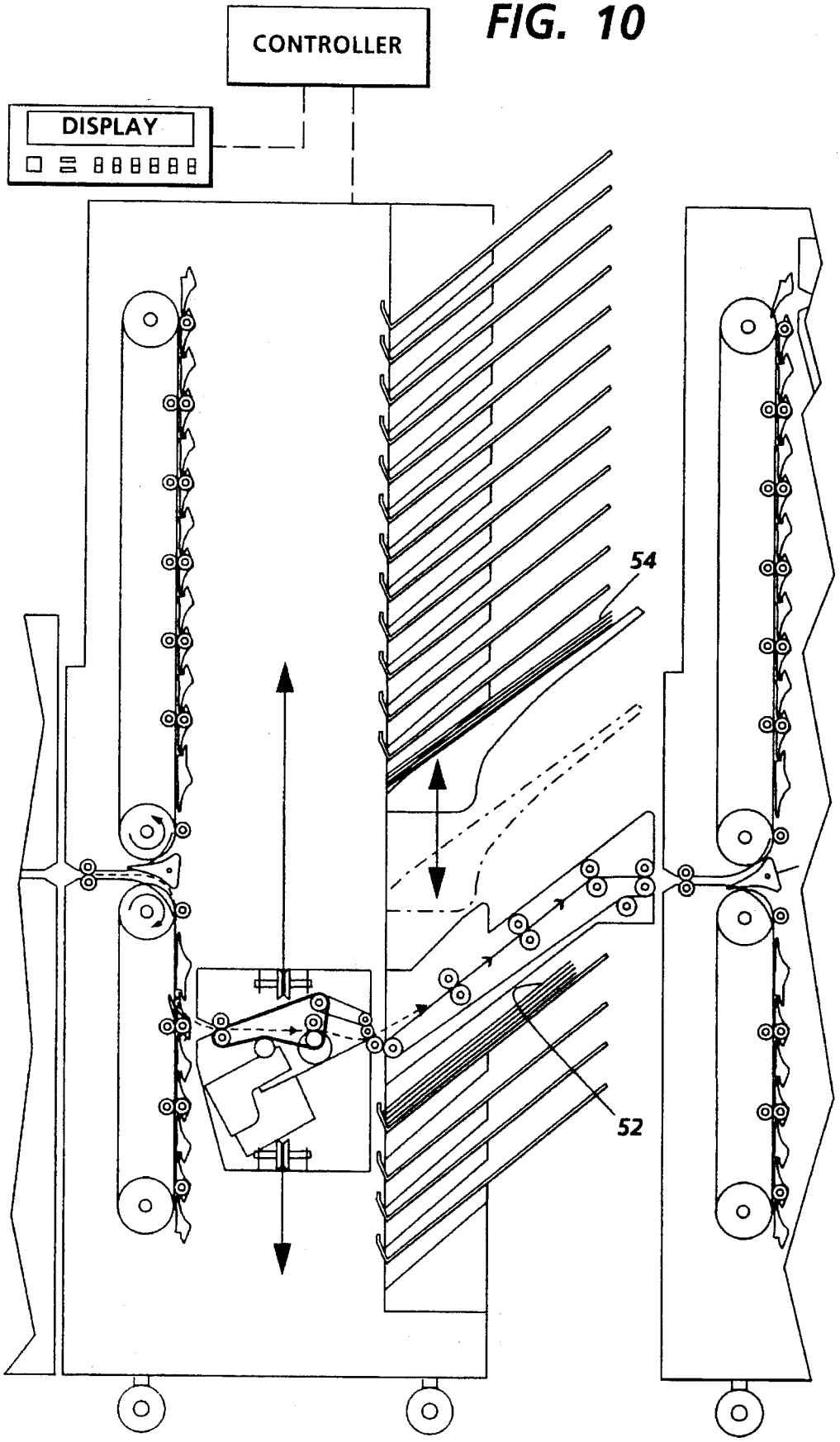
FIG. 10 PRIOR ART

FIG. 10 labeled "prior art" shows, from U.S. Pat. No. 5,382,012, an alternative mailbox unit with a high capacity elevator type stacking tray intermediate the other lower capacity mailbox bins, a bypass transport to other mailbox units, and a vertically moving compiler/stapler unit for optionally placing stapled or unstapled job sets into any mailbox bin or the stacking tray.

Turning now to the exemplary embodiment of a mailbox unit 10 and an exemplary split job special banner sheet system 50 therefor shown in the Figures, and its functions and controls, and other disclosed sensing systems and functions, it will be appreciated that these are merely examples of the claimed system(s). The mailbox system 10 illustrated and described herein is also merely exemplary, and may vary considerably (and another version is shown in FIG. 10). The general reference number 10 is utilized below for the mailbox unit or module. Likewise, the general reference number 11 will be used throughout for an individual mailbox (bin). Bin 11*a* here is an exemplary higher stacking capacity open overflow bin, conventionally located here as the top bin. By way of one example of the split job indicating system 50 here, a first bin banner sheet 52 is shown as the top sheet in one exemplary assigned bin 11, and an overflow bin banner sheet 54 is shown in another bin, e.g., the bin 11*a*.

Various printers (of which printer 14 in FIGS. 5 and 6 is merely one example) may be connected to these and other mailboxing systems, with little or no printer modifications, as part of various systems. Preferably the mailbox unit has an input which adapts or adjusts to various printer output levels, or an interface unit or interconnect transport may be provided in a known manner to sequentially feed the printer output sheets from the printer into the sheet input entrance of the mailbox unit, or, the mailbox unit can be integral the printer unit, built into one end thereof. The conventionally sequentially received hard copy of plural page documents from a pre-collation output electronic printer 14 or the like is fed into the mailbox unit 10, where it is automatically controlled by a controller 100, or otherwise, for the particular bin 11 assignment or destination of the particular job sheets. As noted previously, the mailbox unit 10 preferably directs all designated sheets of a users job to an available bin or bins 11 temporarily assigned to that particular printer user, based on bins availability.

In FIG. 6, merely by way of an example, the exemplary shared user electronic printer 14 is shown connected into a conventional prior art inneroffice or interoffice system electronic network with various remote user terminals (workstations) 15, one of which is shown here in an enlarged view. Some other possible typical network system components are also illustrated and labeled.

As noted, the disclosed mailbox unit 10 can be a universal or dedicated stand-alone unit that is attached to, or even simply moved next to, the output of almost any conventional printer. However, it may be also be conventionally integrally cantilever mounted to the output end of the printer 14. This particular illustrated mailbox unit 10 has plural fixed bins 11, like a fixed bins sorter, and does not have an integral collator or finisher, but as described above and disclosed in the incorporated prior patents, it could.

Also, as is well known in sorting, bin units can be extended or serially connected to provide additional bins, where desired. Plural mailbox units may be ganged in series like plural sorters using sheet pass-through feeders and gates. E.g., Xerox Corporation mailbox unit patent U.S. Pat. No. 5,382,012 issued Jan. 17, 1995, reference no. 22, shown in FIG. 10 here.

The top bin or tray 11*a* of the unit 10 may conventionally provide an open or "public" bin. A top bin is commonly used for undesignated or unknown user's jobs, job overflows, jam purges, etc., since it is not limited in stack height by any overlying tray. This tray 11 a may be commonly shared as an overflow tray by the users of the printer 14.

The relatively low capacity (e.g., less than 100 normal sheets) mailbox bins 11 normally used for separating plural printing, copying or fax jobs by users may also (or alternatively to tray 11*a*) be supplemented by optional sheet delivery into a high sheet capacity stacking tray system, such as an elevator tray. That can be an optional module mounted onto the same frame in place of one or more of the mailbox bins, as disclosed in above-cited patents including U.S. Pat. Nos. 5,382,012 or 5,370,384.

As variously taught by above-cited patents, the disclosed mailboxing system can provide for stacking the sheets sequentially outputted from the printer 14 in separate job sets into one or more temporarily and variably assigned "mailboxes" 11 of a "mailboxing" or job sorting accessory unit 10 having a number of variably assignable mailbox bins 11. This assignment can be by a controller 100 controlling a sheet distribution system 16. This internal sheet feeding in the mailbox unit 10 can utilize various different known random access bin selector type sorter sheet transports, many of which are known in the art. As noted, various components of the mailbox unit 10 can be conventional, even commercially available, except as controlled and modified as described herein. Various feeding and gating arrangements whereby inputted sheets are fed to and gated into selected bins, by a moving gate sheet deflector mechanism, or separate associated bin gates as here, from a sheet transport, are well known in the art. The one described herein is merely exemplary.

Figure 2:
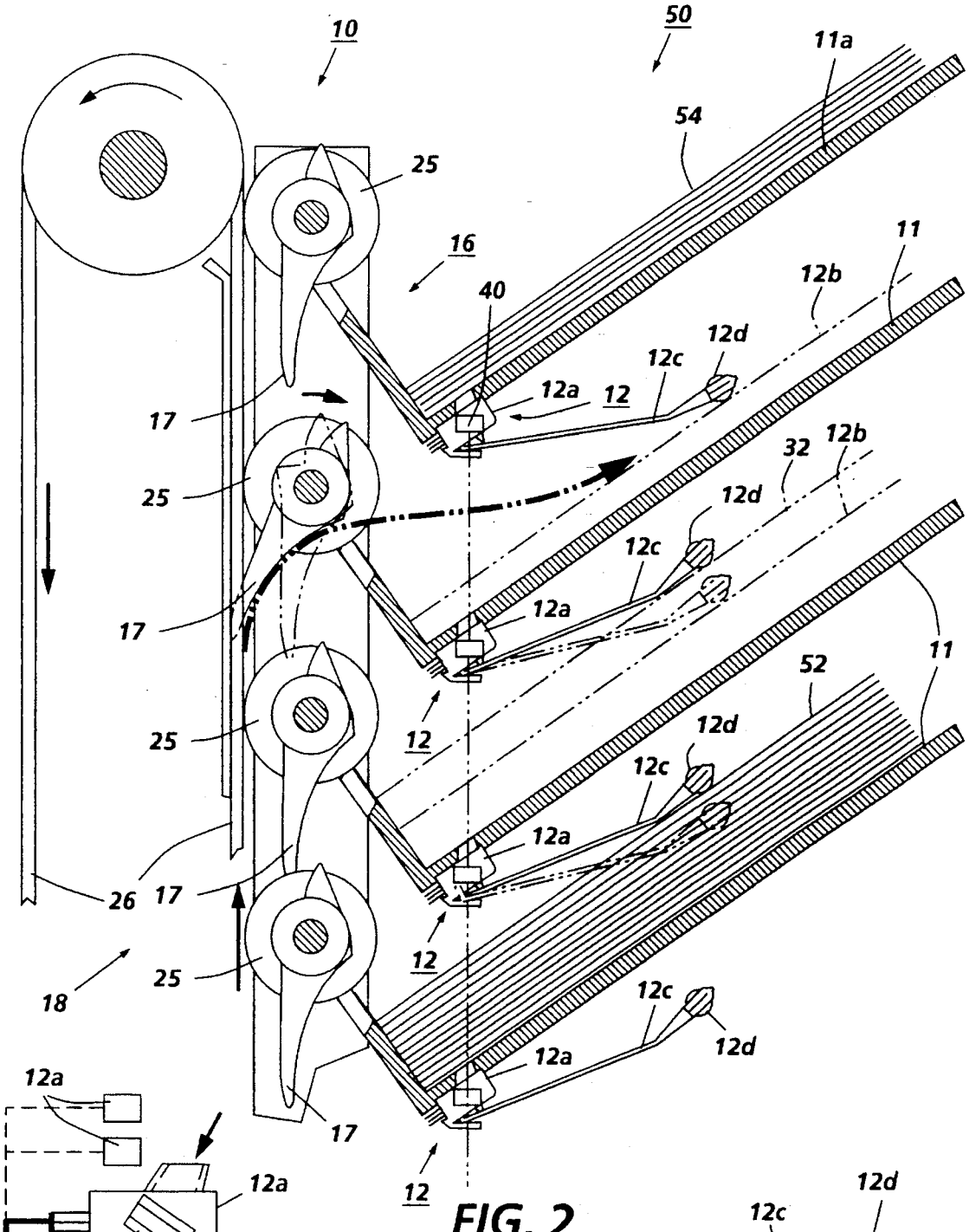
FIG. 2 is in an enlarged partial view of the exemplary mailbox unit of FIG. 1.

Here there is shown in the example in FIGS. 1 and 2 a known type of sheet distribution system 16 comprising a bin selection system with solenoid or moving actuator actuated sheet deflector gates 17 picking sheets off of a vertical sheet transport 18 into a selected bin 11. The sheet is deflected into a selected bin 11 when the sheet reaches a solenoid opened gate 17 adjacent the selected bin or tray 11 entrance, as is well know per se. The vertical transport 18 is sequentially fed sheets received from the operatively connecting printer 14 by the mailbox unit 10 sheet input 20. The vertical transport 18 may comprise belt rollers 25 respectively engaging plural belts 26 to form feed nips which feed each sheet along the moving belts 26 until the sheet meets an actuated gate 17 (or other bin selection and infeeding means). A backing slide plate or backing rollers may be provided against the rear of the belts 26 to hold the belts 26 against the rollers 25, as disclosed for example, inter alia, in Xerox Corporation mailbox unit patents U.S. Pat. No. 5,382,012 issued Jan. 17, 1995 or U.S. Pat. No. 5,370,384 issued Dec. 6, 1994. One flight or bight of the moving belts 26 carries the sheets thereon upwardly from the bottom of the unit 10 from input 20 past the series of gates or sheet deflectors 17, as long as they are unactuated. The belts 26 are laterally spaced apart so that the fingers of the selected gate 17 may pivotally extend between the belts 26 when that gate 17 is actuated by the controller 100.

The exemplary disclosed mailbox system 10 may sequentially stack unstapled user sheets directly in a mailbox bin, as shown, without any job set compiling or stapling. However, the latter may be provided, as fully described in above-cited mailbox patents. In either case, what is normally desired in each mailbox bin are plural, pre-compiled, preferably offset (and/or pre-stapled) job sets stacked in selected bins respectively assigned to respective users of the printer 14. What is also desired is an automatic overflow assignment system of additional temporarily designated bin(s) for identified users, as needed, to provide effectively unlimited or "virtual bin" plural job stacking. As will be described, here in this example this bin reassignment and/or job overflow system is integral a bin-almost-full sensing system 12.

As described in said cited mailbox patents, a variable display may be provided to indicate the assigned bin and any overflow bins into which that particular users print jobs have been placed last and not yet removed. This instructional display can desirably be on the respective user terminal 15 display (FIG. 6). The mailbox system can automatically generate network messages sent back to the user's (job senders) terminal 15 and/or to the systems administrator terminal, if desired, so that the terminal screen displays a status message like "your print job is completed—remove it from bins #3 and 4"; or "the printer is out of paper"; or "all bins are full—clear bins to continue printing", and the like.

An additional LCD or other operator display such as 104, and a conventional keypad such as 102 for access to any locked bins, can be provided on a convenient upper surface of the mailbox unit 10, as shown in FIG. 5. Both are operatively connected with the mailbox unit 10 controller 100. Also, or alternatively, the illustrated display and/or keypad on the printer 14 user interface (UI) may be used. The disclosed "mailboxing" units may have "privacy doors" which are normally locked to restrict access to at least some of the mailbox bins, with electrical unlocking of selected bins privacy doors in response to entry of a access code for that user on the keypad, and/or other features, as also described in the above cited mailbox patents.

As fully explained in connection with the example thereof in said above cited U.S. Pat. No. 5,328,169, once customers fully remove all their print jobs from their bins 11, a bin empty sensor system, (such as is provided by optical bin empty sensors 40 in the present example), indicates to the system controller 100 that those emptied bins are now available for new jobs use and/or user reassignments. I.e., an in-bin bin-empty sensor system determines mailbox bin availability.

As further described in said U.S. Pat. No. 5,328,169 and related patents, one aspect of such a "dynamic" (variable) user bin assignment system is that each "mailbox" (separate bin to be utilized therefor) can be frequently checked (updated) for reassignment of that bin to a new user. That is, reassignment to other users of bins which have since become available by the removal of all the printer output sheets therefrom by the previous user of those bins. The mailbox controller 100 can periodically interrogate the bin-empty sensors 40 to see which bins 11 are then empty. This interrogation is preferably done each time the printer and/or print server is sent (and/or is preparing to print) a print job. Unlike a sorter or collator, it is not necessary to free up (empty) a whole series of bins. Any one free bin can be fed job sheets, even if that one empty bin is between other, unemptied, bins. The bins assigned are then stored in memory, and can be identified whenever jobs are to be retrieved.

However, as discussed above, there are situations is which a bin-empty sensor can be inadequate. Turning now to the disclosed example of a bin-almost-full system 12, each of the mailbox user bins 11 has an "almost-full" bin condition sensor such as 12*a* that is triggered when the stack height of the sheets in that bin reaches a preset almost-full level, e.g., approximately 10 to 15 normal sheets from the full or maximum desired stacking capacity of that bin, e.g., 50 normal sheets. This "almost-full" condition or level trigger point of the sensor 12*a* is shown here by the phantom line 12*b* in each bin 11. A bin full level phantom line 32 thereabove illustrates the preset maximum desired stacking level in that bin 11, and the actuating level of the bin full sensor, which in this example is provided by a second and higher level switch point of the same sensor 12*a*, as will be further described.

Turning now to the exemplary bin "almost full" and "bin full" sensors 12*a*, these can be any suitable in-bin stack height sensor providing the desired described functions or features. The sensors 12*a* should avoid undesirable features such as switch arms that can become bent by incoming sheets or paper jam removals, or be subject to errors from paper lint or torn paper scrap blockage. As shown enlarged in FIGS. 3 and 4, the sensors 12*a* can be an electrical switch with an actuating arm such as 12*c*. The actuating arm 12*c* should be sturdy, to resist sheet or operator damage, but have a low resistance to both sheet entry into the bin and job sets removal from the bin. FIG. 4 is a top view of the stack engagement end of the actuating arm 12*c* showing a loosely mounted rotatable ball 12*d* there, as one example. The ball 12*d* provides both low resistance to stacking more input sheets thereunder from one axis, and low resistance to removal of the accumulated sheets from thereunder on another axis. The actuating arm such as 12*c* may be mounted to or under the bottom of the overlying tray so as to extend the in-bin stack top engagement point thereof (the switch arm 12*c* outer end) down into the bin to be sensed by a distance corresponding to the desired amount of stacking level or head space to be left in that bin when the sensor 12*a* actuates, here the almost-full level 12*b*. The switch arm 12*c* end location (the top of stack sheet engagement positions should preferably not be located near the sheet stack edge, i.e., be more centrally located in the bin, so as to avoid stack height sensing errors from edge curled or bent paper in the bins changing the true stack height or distance from the true preset full level 32.

Figure 3:
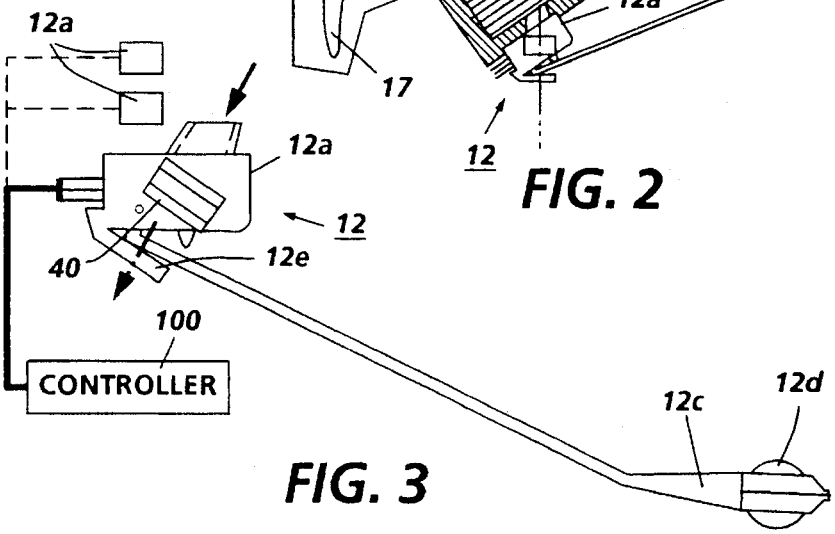
FIG. 3 is an enlarged partial view of the exemplary switch unit of the exemplary integral bin almost-full, bin full and bin empty sensing systems of the exemplary mailbox unit of FIGS. 1 and 2.
Figure 4:
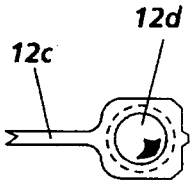
FIG. 4 is a partial enlarged top view of the exemplary low sheet resistance actuating end of the exemplary stack height sensing arm of the exemplary switch unit of FIG. 3.

As best shown in FIGS. 2 and 3, as noted above, this particular example of an integral sensor 12*a* has two integral switches or switch positions, so as to provide two different signals, one signal at the almost full level level 12*b*, and another signal as the stack height in that bin reaches the bin full level 32. Both are respectively actuated by respective positions of the switch arm 12*c* as the bin 11 fills if that bin is filled with print jobs to that extent. An arm stop 12*e* may also be provided so that the arm 12*c* does not ever drop substantially below the bin almost full level level 12*b*. The stop 12*e* holds the arm 12*c* completely out of the paper path, for completely unobstructed sheet movement, until the stacking level reaches approximately the bin almost full level level 12*b*. For wiring convenience and cost reduction, the bin-empty sensor 40 in this example is also mounted to or integral the same sensor unit 12*a*, although a separate signal is provided. Here the bin-empty sensor 40 is optical, looking up through an aperture in the overlying bin to which it is mounted to the next sensor 40 above that bin, and thus indicating if there are any sheets therein obstructing the light beam path therebetween.

The "bin almost full" condition signal may be desirably used to generate a display instructional signal via controller 100 to the terminal of the assigned user of that bin, allowing that user several options when that user attempts to electronically send another print job to his or her assigned bin.

Among the options that can be provided to the user are: (A) display a message instructing the user to go to the mailbox and empty the bin or remove enough sheets from it until the "almost-full" condition (signal) disappears, and then print the job; (B) at the user's request (job instruction key or mouse entry), split the job or jobs between the user's assigned bin and the overflow tray; and/or (C) at the user's request, send the entire job to a different output such as the overflow tray 11*a*, or another unutilized, unassigned, bin 11, the printer's own separate output tray, or a finisher, if the printer has an output tray or finisher output in addition to the mailbox output.

If the user ignores or overrides a displayed instruction to empty or remove sheets from a bin with an actuated "almost-full" sensor, and chooses to continue to send the print job(s) to the same "almost-full" bin anyway, if the print job is small (e.g., less than approximately 15 sheets) the printer may try to feed it into the "almost full" bin, with the assumption that there will be enough room in the bin for the entire job. However, if there is not enough room in that bin for feeding in the rest of that print job, and the "bin-full" sensor is actuated, the print job can be split between the user's assigned bin 11 and the overflow tray 11*a*, and the user then informed of that automatically through a message. This option can also be used as a default in the case where the "bin-almost-full" condition is reached in the middle of a large job that will not all fit in the bin. However, if there is no additional "bin-full" sensor or signal in the bin (as there is in the example here), and the "bin-almost-full" condition exists prior to sending the job to the printer, then by default the entire job should be redirected to the overflow tray or another output area.

While it may be normally undesirable to split any job between two different output areas automatically by default, if the "bin-almost-full" condition exists prior to sending a print job, the user can be given the option to select to split the job between his or her assigned bin and the overflow tray. This user option will provide the user with greater flexibility in the use of the printer to accomplish maximum productivity. And since the user will be automatically told where the different sections of that job reside if it is so split, this will minimize the confusion that can otherwise result from splitting a print job.

Furthermore, if the "bin-almost-full" condition exists prior to sending a print job, either by default or by giving the user the option, the entire job can be sent to a different output area such as the overflow tray, another unutilized unassigned bin, or the printer's output tray, while informing the user.

As noted, another significant advantage of this "almost full" and/or "full" bin sensor system is that it covers or protects the situation in which a user pulls out only part of the jobs from his or her bin but leaves the rest of the sheets in the bin. A "bin-empty" sensor would not be activated in that case. That situation will not fool or confuse the "almost-full" sensor when it is subsequently interrogated by the controller 100. A similar situation occurs if the bin is first fully emptied but then the user re-inserts part of its content back into the bin.

To express the user system options in other words, each of the shared user printers mailbox user bins 11 (except normally for the higher capacity overflow bin 11*a*) will have an "almost full" bin sensor that will be triggered when the stack height of the sheets in that bin reaches approximately 10 to 15 sheets, or another preselected number, from the preset full or maximum capacity of the bin. This "almost full" signal can be sent back over the system network in a known manner to the terminal of the user of that bin when that user attempts to electronically send another job to his or her assigned bin. The user's terminal will then preferably: (a) display a message instructing the user to go to the shared printer and remove the sheets from that "almost full" bin; (b) If the user does not do so, and sends the next job to the "almost full" bin anyway, then (c) if it is a small job, it will go into that same bin until the bin actuates the "completely full" sensor in the bin, but if (d) the job size of the new job exceeds the total available or "full" space in the "almost full" bin, that entire job will then be directed to the overflow tray, so as not to split the job.

It should be appreciated, however, that the bin almost full system 12 is not essential to the subject system 50 of special banner sheets for split print jobs, as further disclosed herein.

The subject system 50 makes a more efficient use of the mailboxing system more practicable by much more clearly indicating to users that a portion of their print job or jobs are located in other, different, output bins, thereby making split jobs less disadvantageous, and thus enabling more bins to be more nearly filled to capacity for more efficient utilization. That can increase the number of users who may share a single printer with a given limited number of mailbox bins. Furthermore, it may reduce the number of time periods in which the printer must be shut down until users free up mailbox bins, or the number of times in which print jobs must be sent to a common or overflow stacking bin or tray because of the absence of empty bins or bins with additional stacking capacity at any particular time. That is especially the case for print jobs having a large number of sheets per document set, and where the sets are unstapled so that they may be split between bins. Or, for a large number of sequential print jobs by the same user.

The present system automatically generates (prints in the printer) a banner sheet whenever a mailbox unit requires splitting a job (or the placement of a portion of a job for any other reason) in a location other than where it was expected, i.e., the initially designated bin which that user is informed his job is being directed to. The banner sheet is printed with instructions which clearly tell the user that his or her job has been split and desirably also tells where the remainder of that split job has been sent, i.e., in which bin(s) it is located. Desirably, a second banner sheet is also created for that portion of the job which has been placed in this additional unexpected or overflow location.

A user also needs to know whether he or she has picked up his or her entire job, or if not, where the remainder of the job is located. Thus, the banner sheet system here, by the absence of a banner sheet in a first bin, can also assure the user that there has not been a job or job portion placed in another, additional, bin. I.e., with this system, the absence of a banner sheet can also be significant information, since banner sheets are desirably only used here where a job has been split. In the present system, a banner sheet such as 52 is only generated when a control signal is received from the controller 100 that there must be the splitting of sheets between two locations for a particular user's print job or jobs. (However, if desired, a regular "end of job" or "job complete" banner sheet may be generated instead.

This banner sheet generation may be controlled or signaled by a bin approaching its sheet holding capacity, as sensed by a sensor in the bin, connected to the controller 100, as described herein, and/or by counting the sheets in the print job being sent to the bin, which information is already electronically available in the print queue or print server for the printer, or otherwise, as explained in the cited art. The controller then decides which is the last sheet which will be sent to the originally assigned bin, and prints and inserts at that point the banner sheet 52 into the stream of sheets going into the mailbox unit 10 immediately thereafter, so that that banner sheet 52 is fed by the sheet distribution system 16 of the mailbox and the deflector gate 17 into that first mailbox bin, thereby ending up, as shown, on top of the split job in that particular bin 11 as the last sheet in that bin. Of course, it will be appreciated that previous print jobs for which there was room in the bin may already have been printed and stacked in that same bin, without any banner sheets for those jobs. I.e., it is only a last print job which must be split because of space limitations in the bin which is provided with a banner sheet 52 in this system.

As shown in FIG. 8, the exemplary special banner sheet 52 may desirably contain printed messages such as a large print statement that: "this is a split job, and the rest of your job is in bin Number _____" (or, "the top overflow bin").

As noted, preferably a second and different special split job banner sheet 54, the overflow banner sheet, is subsequently printed after the rest of the split job has been printed and directed to the selected overflow bin or bins. That is, the overflow or second banner sheet 54 (such as in FIG. 9) is printed as the last sheet of the completed job set and is directed to and placed on top of those sheets completing the job set, so as to also be readily visible to the operator. Printing the banner at a natural job break is desired, but not required. If the overflow of the split job is directed to a common shared bin, such as the high capacity bin **11*a* or other stacking tray, the second banner sheet 54 placed in that bin may be desirably of the type described in the above-cited U.S. Pat. No. 5,316,279, that is, be rotated 90°, or printed on a larger size sheet so as to extend from the edge of the stack and be more readily visible. This second banner sheet 54 will preferably have a different message printed very visibly thereon, such as: "This is the remainder of the print job (or fax) in bin _____, for user A. Smith", or the like. The number of sheets may also be indicated on either or both banner sheets, e.g., the overflow banner sheet 54** may additionally be printed with something like: "These are pages 15–50 of the document entitled 'Acme Corporation Business Plan' printed May 12, 1995 at 1:15 p.m." or the like.

It will be appreciated that if print jobs are being sent to mailbox bins or an overflow tray in a face down orientation, so that page one is on the bottom and the last page is on top, that the banner sheet may need to be inverted (in the sheet inverter commonly available in the printer), and/or printed on its second side, as a duplex page, so that even though the job set is face down in the bins, the banner sheet will be face up and immediately visible to a user going to the bins of the mailbox unit to pick up the job.

It will also be appreciated, as discussed in the above-cited mailbox patents, that if security or privacy door bins are being utilized, the overflow bin may be another locked mailbox bin, and that the system will need to automatically also provide unlocking of the privacy door to that second bin as well as the first bin in the case of a split job. While this is preferably done automatically electronically, it would also be possible to print on the first bin banner sheet 52 the access code or other security information needed for access to the overflow bin if that is required.

Another option is to immediately, before starting another print job, to place a special split job banner sheet 52 into the first bin 11, on top of the previous print jobs, or even into an empty bin, in the event that the next print job is so large that it is decided by either the user or the system to send that entire job to an overflow tray rather than splitting it. In this case, the banner sheet 52 will not be on top of any portion of the split job and it will inform the operator that that the entire print job has been redirected to a higher capacity bin or tray because of its size. In that case, preferably the overflow bin banner sheet 54 will also differ in that it will also provide an explanation to the user approaching the system for job removal that the entire print job has been redirected to that higher capacity tray rather than the originally assigned mailbox bin for that user. This latter system is particularly useful in the case of a mailbox system which does not provide dynamic reassignment of additional mailbox bins, i.e., a more primitive mailboxing system in which the bins are permanently or semi-permanently assigned to specific users and/or only one particular bin is available to a particular user, and the user expects to always find his or her print jobs just in that one bin.

Another option (electronically selectable) is to electronically direct the overflow portion of the split job or additional jobs for that user to an empty bin of another mailbox at another printer on the network at a different location. In that case, the banner sheets will indicate that the rest of the user's job(s) are being printed by that other printer, and indicate its location as well as which mailbox bin or tray thereof is receiving the overflow.

As noted, generation of the banner sheets is a relatively simple matter using existing technology, such as that already provided for job banner sheets. The banner sheets may be generated on the fly by a signal from the mailbox processor to the print controller (which would normally also retain the job identification information). The format of the job, and a print form for the banner, may be stored in machine memory as a form, as is well known. The specific job description information can be automatically inserted into the form template, as is well known. Patents on electronic printer forms generation are cited above, and they include U.S. Pat. No. 4,903,229 to Schmitt, et al (Pitney Bowes), and Xerox Corp. GB 2 198566A, published Jun. 15, 1988.

As is well-known, a stored cover (banner) sheet form can also include large graphic and/or background patterns so that a banner sheet can be clearly distinguishable from a document sheet when printed. E.g., the banner sheets generated for each print job by the Xerox Corp. "2700" and other electronic printers.

It will be apparent that other options will be available with the information sources and signals provided. Note that the "bin almost full" status signal, even if provided, is desirably in addition to, and in cooperation with, "bin empty" and "bin not empty" signals for each bin.

As noted, the entire operation of the exemplary mailbox module unit 10 here may be controlled by an integral conventional low cost microprocessor chip controller 100, conventionally programmable with software for the operations described herein. Such a system has ample capability and flexibility for the functions described herein, and also for various other functions described herein, if desired, such as jam detection and jam clearance instructions. Also, various means, systems and software for document generation, networking and printer control and interaction are described in above cited patents and other publications, including commercially available software, and need not be described in detail herein.

As discussed above, a shared user printer output job can be generated and sent to a mailbox unit from various sources. For example, a user can send a job to a printer from their respective workstation, e.g., from a screen display menu or job ticket. Another potential job source is a facsimile document or message addressed or directed to that printer, preferably with a designated recipient's mailbox or other user code number sent with the fax message. The print server or mailbox unit can also then send an acknowledgement message to the designated recipient's workstation. A print job can also be sent to another person's printer and mailbox bin directly, without going to their workstation, by other system users or by intra-systems electronic mail.

It will be appreciated that many additional user option selections, and instructions for such selections, and other user instructional information, may be provided and automatically displayed. For example, users may be instructed to remove all sheets in a mailbox bin, and/or to not manually insert covers or other insert sheets into a bin unless a "stop print", pause, bin reassignment, or insert mode instruction is entered, to avoid a jam if further sheets are to be fed into that bin, or to remove sheets left for too long a time in bins.

Although it is not normally desirable to put different users jobs in the same mailbox bin 11, the split job system 50 can be used to avoid a printer 14 shutdown in the event that no bins are empty, (because the system messages to the users to remove their print jobs from their bins have not been answered in time to fully free up any bin). Under those circumstances, if there is still some stacking room in at least one bin, another users print job or fax can be placed therein, if it is not too many pages, or at least the first part thereof. A separate automatically inserted or interposed banner or cover sheet can be used for job separation from the other users print jobs in that bin, and a special network message will be generated telling both users that they must access that same bin.

While the embodiments disclosed herein are preferred, it will be appreciated from this teaching that various alternatives, modifications, variations or improvements therein may be made by those skilled in the art, which are intended to be encompassed by the following claims:

What is claimed is:

1. In a shared users printing system, with an electronic printer for printing respective plural print jobs of plural printed sheets of respective different plural users of said printer, with a printer mailbox system connected to said electronic printer to receive said print jobs from said electronic printer, said printer mailbox system having multiple individual print job storage mailbox bins of a limited preset maximum sheet stacking capacity, and a sheet distribution system for automatically variably directing and stacking into different said individual mailbox bins electronically assigned to different respective users the respective plural print jobs of the different plural users of said electronic printer, wherein at least the initial portion of a first print job of a particular user is directed to a selected first said mailbox bin assigned to that user, the improvement comprising:

a control system controlling said sheet distribution system in a job splitting program in accordance with said maximum sheet stacking capacity of said first bin to divert subsequent printed sheets of a print job being printed for that particular user which would exceed said maximum sheet stacking capacity of said first bin to at least one other bin and in coordination therewith controlling said printer to automatically print and automatically insert a special banner sheet as the last sheet inserted into said first bin as the top sheet in said first bin, which special banner sheet is automatically printed with readable indicia indicating that said subsequent printed sheets for that user are being so diverted to said other bin.

2. The shared users printing system of claim 1, further including an in-bin sensing system providing a control signal to said control system indicating when said maximum sheet stacking capacity of said first bin is being reached.

3. The shared users printing system of claim 1, wherein said electronic printer is provided with electronic information as to the number of printed sheets of a print job being printed for that particular user, and wherein said control system controls said sheet distribution system to direct a subsequent print job from said electronic printer which would exceed said limited preset maximum sheet stacking capacity of said first bin to a different said individual mailbox bin.

4. The shared users printing system of claim 1, wherein said banner sheets are only printed in response said job splitting program for a partially diverted said print job and not for normal unsplit print jobs.

5. The shared users printing system of claim 1, wherein another special user identifying banner sheet is automatically printed and inserted into said other bin with said diverted subsequent printed sheets of said print job in a position to identify said diverted subsequent printed sheets.

6. The shared users printing system of claim 5, wherein said other bin comprises a higher sheet stacking capacity overflow tray which is commonly shared by plural said users.

7. The shared users printing system of claim 1, wherein said other bin comprises a higher sheet stacking capacity overflow tray.

8. The shared users printing system of claim 1, wherein respective said different users of said printer are in networked electronic communication with said printer from respective user terminals, wherein at least some of said respective different plural users of said printer are at remote said user terminals, and said control system is partially programmable by said respective users from said respective user terminals.

9. The shared users printing system of claim 1, further including an in-bin sensing system providing a control signal to said control system indicating when said maximum sheet stacking capacity of said first bin is being reached; wherein said electronic printer is provided with electronic information as to the number of printed sheets of a print job being printed for that particular user, and wherein said control system controls said sheet distribution system to direct a subsequent print job from said electronic printer which would exceed said limited preset maximum sheet stacking capacity of said first bin to a different said individual mailbox bin; wherein said banner sheets are only printed in response said diverted print job and not for normal print jobs; and wherein another special user identifying banner sheet is automatically printed and inserted into said other bin with said diverted subsequent printed sheets of said diverted print job in a position to identify said diverted print job.

* * * * *